US009222755B2

(12) United States Patent
Zondervan

(10) Patent No.: US 9,222,755 B2
(45) Date of Patent: Dec. 29, 2015

(54) INTERCEPTING VEHICLE AND METHOD

(71) Applicant: The Aerospace Corporation, El Segundo, CA (US)

(72) Inventor: Kevin L. Zondervan, Alexandria, VA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 14/171,307

(22) Filed: Feb. 3, 2014

(65) Prior Publication Data

US 2015/0219423 A1 Aug. 6, 2015

(51) Int. Cl.

| | |
|---|---|
| ***F41G 7/22*** | (2006.01) |
| ***F42B 10/60*** | (2006.01) |
| ***F42B 10/66*** | (2006.01) |
| *F41G 7/00* | (2006.01) |
| *F42B 10/00* | (2006.01) |

(52) U.S. Cl.

CPC . *F41G 7/22* (2013.01); *F42B 10/60* (2013.01); *F42B 10/66* (2013.01)

(58) Field of Classification Search

CPC ..... F41G 7/22; F41G 7/2213; F41G 7/222; F41G 7/2226; F41G 7/2246; F41G 7/2253; F41G 7/226; F41G 7/2273; F41G 7/2286; F41G 7/2293; G01C 21/02; G01C 21/025; F42B 15/01; F42B 10/60; F42B 10/62; F42B 40/64; F42B 10/66; F42B 10/661; F42B 10/663; F42B 10/665; F42B 10/666; F42B 10/668; B64C 9/38

USPC ..... 244/3.1, 3.19–3.3, 1 R, 3.15–3.18; 318/560, 580, 582, 584–586; 342/61, 342/62, 73–81; 701/400, 408, 500–513; 60/200.1, 201, 227–232

See application file for complete search history.

(56) References Cited

U.S. PATENT DOCUMENTS

| | | | | | |
|---|---|---|---|---|---|
| 3,113,429 | A | * | 12/1963 | Davies | B64C 9/38 60/230 |
| 3,841,585 | A | * | 10/1974 | Evers-Euterneck | 244/3.15 |
| 4,063,685 | A | * | 12/1977 | Jacobs | 244/3.22 |
| 4,158,845 | A | * | 6/1979 | Pinson | 244/3.16 |
| 4,266,173 | A | * | 5/1981 | McTigue et al. | 318/585 |
| 4,562,439 | A | * | 12/1985 | Peralta et al. | 342/81 |
| 4,679,748 | A | * | 7/1987 | Blomqvist et al. | 244/3.19 |
| 4,830,311 | A | * | 5/1989 | Pritchard et al. | 244/3.15 |
| 4,886,222 | A | * | 12/1989 | Burke | 244/1 R |
| 5,076,511 | A | * | 12/1991 | Stein et al. | 244/3.22 |
| 5,078,336 | A | * | 1/1992 | Carter | 244/3.22 |
| 5,088,658 | A | * | 2/1992 | Forsmo | 244/3.21 |
| 5,088,659 | A | * | 2/1992 | Neff et al. | 244/3.16 |
| 5,669,579 | A | * | 9/1997 | Zacharias | 244/3.15 |
| 5,836,540 | A | * | 11/1998 | Romer et al. | 244/3.16 |
| 5,848,764 | A | * | 12/1998 | Schneider | 244/3.15 |
| 6,121,606 | A | * | 9/2000 | Voigt et al. | 244/3.16 |
| 6,198,564 | B1 | * | 3/2001 | Knight | 244/3.16 |
| 6,520,448 | B1 | * | 2/2003 | Doty et al. | 244/3.23 |
| 7,185,845 | B1 | * | 3/2007 | Hartman et al. | 244/3.16 |
| 7,500,636 | B2 | * | 3/2009 | Bredy | 244/3.15 |
| 8,610,041 | B1 | * | 12/2013 | Boardman | 244/3.19 |
| 2008/0258004 | A1 | | 10/2008 | Hasson et al. | |
| 2012/0068000 | A1 | | 3/2012 | Goldner et al. | |

* cited by examiner

*Primary Examiner* — Bernarr Gregory
(74) *Attorney, Agent, or Firm* — LeonardPatel PC

(57) ABSTRACT

A simpler, smaller, less costly intercepting vehicle is provided. For example, a highly scalable intercepting vehicle may include a single axial rocket motor and a body-fixed, wide field of view (FOV) sensor unit to accommodate attitude changes required to steer the intercepting vehicle. This intercepting vehicle may be much smaller and less costly than conventional intercepting vehicles.

26 Claims, 8 Drawing Sheets

FOV: Field of View
LOS: Line of Sight Vector
V: Relative Velocity Vector
a: Relative Acceleration Vector

600

INTERCEPTING VEHICLE AND METHOD

FIELD

The present invention relates to intercepting ballistic and airborne vehicles with an intercepting vehicle.

BACKGROUND

Conventional intercepting vehicles for ballistic missiles (also known as kill vehicles) generally use an axial rocket motor (or a single rocket motor whose thrust direction is along its longitudinal axis) with a gimbaled sensor unit, or a cruciform rocket motor with a body-fixed sensor unit. There are also intercepting vehicles with cruciform rocket motors and gimbaled sensor units. The sensor units generally have a narrow field of view (FOV) of a few degrees.

Further, these intercepting vehicles are generally complex, costly, and relatively large. For example, cruciform divert rocket motors using solid fuel are difficult to manufacture below the size currently used in conventional intercepting vehicles. Liquid-fueled intercepting vehicles are more scalable than solid-fueled intercepting vehicles, but are also more hazardous and complex.

Thus, a simpler, smaller, less costly intercepting vehicle may be beneficial. For example, a highly scalable intercepting vehicle with a single axial rocket motor and a simple, body-fixed, wide FOV sensor unit that accommodates the attitude changes required to steer the vehicle, may be beneficial. Such an intercepting vehicle can be much smaller and less costly than conventional intercepting vehicles.

SUMMARY

Certain embodiments of the present invention may provide solutions to the problems and needs in the art that have not yet been fully identified, appreciated, or solved by current intercepting vehicles. For example, some embodiments of the present invention pertain to an intercepting vehicle having a single axial rocket motor (i.e., a single rocket motor whose thrust direction is along its longitudinal axis) and a body-fixed sensor unit. The body-fixed sensor unit may have a wide FOV.

In one embodiment, an apparatus is provided. The apparatus includes a single axial rocket motor and at least one body-fixed sensor unit. The single axial rocket motor is configured to accelerate the apparatus in a desired direction. The at least one body-fixed sensor unit includes a wide FOV to maintain a target within the FOV of the apparatus during attitude changes required to steer or otherwise maneuver the apparatus to intercept the target.

In another embodiment, a computer-implemented method is provided. The computer-implemented method includes tracking a target by a body-fixed sensor unit onboard an intercepting vehicle. The computer-implemented method also includes rotating, by the computing system, a thrusting single axial rocket motor of the intercepting vehicle such that the target remains within the FOV of the body-fixed sensor unit and the intercepting vehicle intercepts the target.

In yet another embodiment, an intercepting vehicle may include a sensor unit and a single axial rocket motor. The sensor unit includes a wide FOV such that a target is contained within the wide FOV. The single axial rocket motor is configured to thrust the intercepting vehicle in a direction that causes the intercepting vehicle to intercept the target while keeping the target within the wide FOV.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Figure 1A:
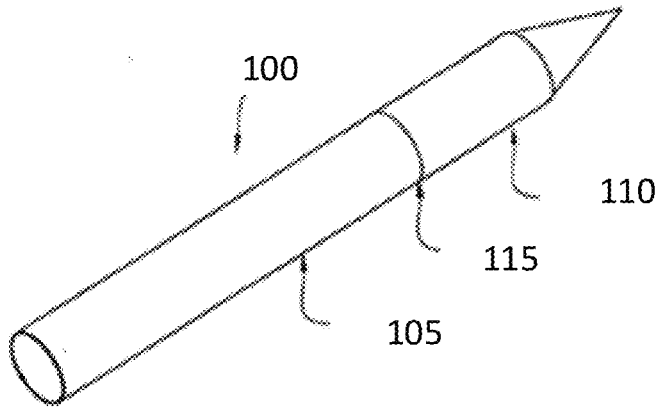
FIGS. 1A and 1B are schematic illustrations of a multi-stage intercepting vehicle, according to an embodiment of the present invention.

Some embodiments of the present invention pertain to an intercepting vehicle to be used in endo-atmospheric and exo-atmospheric flight that is configured to intercept a target and damage it by direct collision or by detonation of a warhead. The target in some embodiments may be an object moving relative to the earth, such as a missile, a satellite, or an aircraft. In other embodiments the target may not be moving relative to the earth. The intercepting vehicle may include a main body. The main body may include a warhead, an electrical power unit, a sensor unit containing at least one sensor configured to track the target within a certain detection range and FOV, an inertial measurement unit (IMU), a computing system, a communication unit configured to receive electro-optical or radio frequency signals, a propulsion unit, and an attitude control system (ACS) configured to provide the intercepting vehicle with thrust in a desired direction. For example, the sensor unit may include radar, ladar, visible cameras, infrared cameras, or any type of sensor unit or combination of sensor units that would be readily appreciated by a person of ordinary skill in the art. As discussed below, the ACS may include a thrust vector control (TVC) system or a non-TVC system or both. Non-TVC actuators for the ACS may be, for example, cold gas or warm/hot gas thrusters, or flaps for endo-atmospheric flight.

The sensor unit may be a body-fixed or body-mounted sensor unit. In the body-fixed approach, a streak-detection method is used to detect and track the target. For example, each time the attitude of the intercepting vehicle is changed to divert or maneuver the intercepting vehicle, the target streaks across the focal plane of the body-fixed sensor unit. This is different from gimbaled sensor units. Gimbaled sensor units keep the target nearly stationary on the focal plane array by rotating the gimbals when the attitude of the intercepting vehicle changes during divert.

The propulsion unit and ACS may include a single axially mounted rocket motor with a single nozzle for thrust, a TVC system as the ACS actuator, one or more non-TVC actuators for the ACS, for example, flaps for endo-atmospheric flight and/or other types of propulsion systems (e.g., cold gas thrusters, warm/hot gas thrusters, etc.), and a computing system for controlling these systems and changing the attitude of the intercepting vehicle. When traveling to the target, the intercepting vehicle may receive sporadic or continuous target information via the communication unit and divert to the estimated intercept point by igniting the rocket motor and thrusting in the desired direction until intercept or closest approach. The desired direction may be achieved by adjusting the attitude of the intercepting vehicle. In some embodiments, the intercepting vehicle may detonate a warhead near the intercept point. In other embodiments, the intercepting vehicle may collide with the target.

Prior to reaching the estimated intercept point, the sensor unit (e.g., body-fixed or body mounted) may be activated and point to the target by rotating the intercepting vehicle such that the target is within the sensor unit FOV. The sensor unit may acquire the target when the target is within detection range. In some embodiments, the sensor unit FOV is large enough to contain the target while accommodating the attitude changes required to steer (e.g., maneuver or divert) the intercepting vehicle. After the target is detected, the intercepting vehicle may autonomously guide itself to intercept the target. It should be appreciated that if the target moves outside of the wide FOV due to the attitude change of the intercepting vehicle, the target may be reacquired within the FOV of the sensor unit by readjusting the attitude of the intercepting vehicle.

The design and configuration of the intercepting vehicle allows the intercepting vehicle to be highly scalable and mass producible. The intercepting vehicle may be as small as a hand-held flashlight, as large as a bus, or any desired size available technology permits, depending on the application.

Figure 1B:
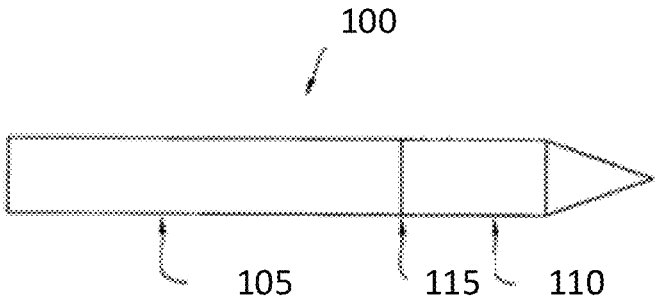

FIGS. 1A and 1B are schematic illustrations of a multi-stage interceptor 100, according to an embodiment of the present invention. Multi-stage interceptor 100 in this embodiment includes a booster rocket 105 and a payload compartment 110 containing the intercepting vehicle (see FIGS. 2A and 2B). Payload compartment 110 in certain embodiments may include one or more intercepting vehicles, allowing multiple intercepting vehicles to be launched simultaneously or sequentially. In certain embodiments, the payload compartment may be omitted and the intercepting vehicle(s) may be connected to the booster rocket via an interstage unit.

To deploy the intercepting vehicle, multi-stage interceptor 100 also includes a separation mechanism 115. Separation mechanism 115 may be, for example, a pyro-electric separation mechanism configured to separate booster rocket 105 from the intercepting vehicle at the appropriate conditions. It should be appreciated that the embodiments described herein are not limited to a specific type of booster rocket. In other words, any type of booster rocket may be used, such as a one-stage booster rocket, a two-stage booster rocket, a liquid-fueled booster rocket, a solid-fueled booster rocket, etc.

Figure 2A:
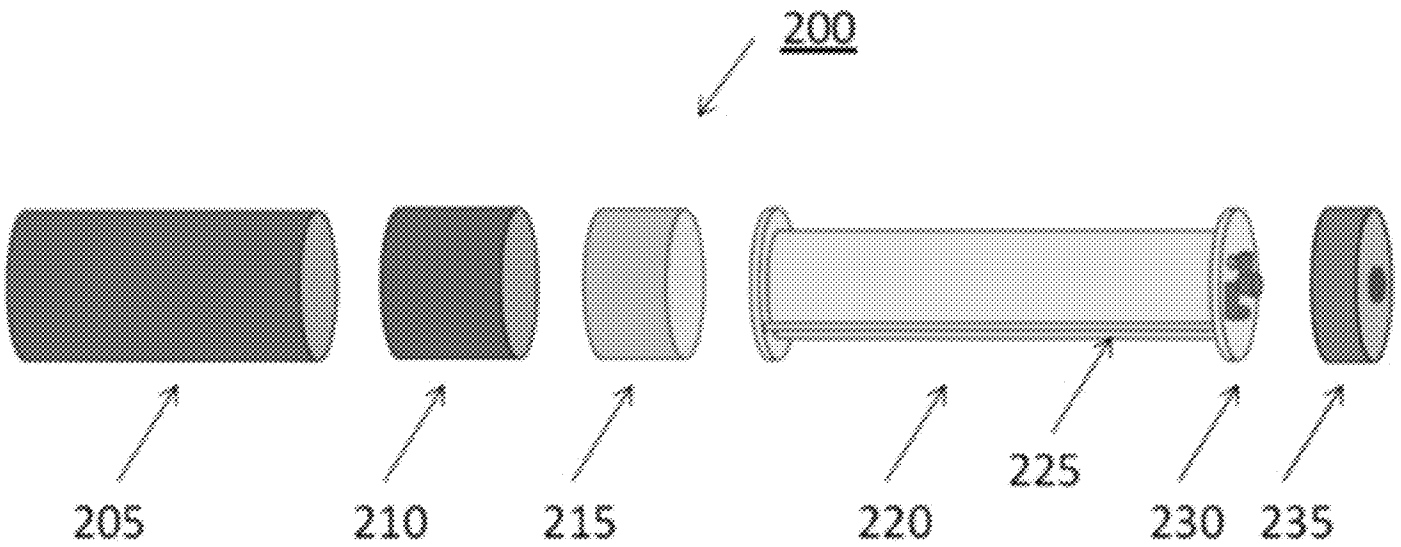
FIGS. 2A and 2B illustrate an intercepting vehicle, according to an embodiment of the present invention.
Figure 2B:
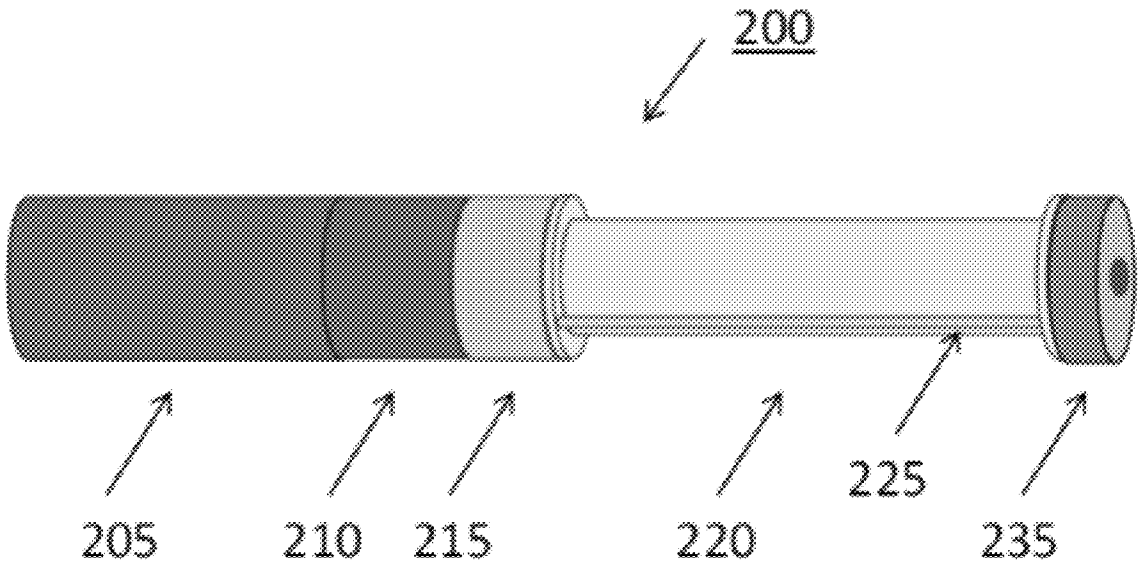

FIGS. 2A and 2B illustrate an intercepting vehicle 200, according to an embodiment of the present invention. Intercepting vehicle 200, in this embodiment, includes sensor unit 205, an electronics unit 210, an IMU and electrical power source 215, a rocket motor 220, a wire conduit 225, a TVC system 230 (several options are described below; the TVC system depicted in FIG. 2 may be any one of these), and a TVC cover 235.

In this embodiment, sensor unit 205 is body-fixed or body-mounted and has a wide FOV. Sensor unit 205 may include a wide FOV visible- or infrared-wavelength camera, a baffle to prevent stray light from entering the focal point array, and electronics to operate sensor unit 205 and obtain data from the wide FOV camera. In some embodiments, sensor unit 205 may include a star tracker to measure the attitude and attitude rate of intercepting vehicle 200. In certain embodiments, the star tracker may be separate from sensor unit 205.

In certain embodiments, the size of the FOV may depend on the larger of 1) the uncertainty in the location of the target relative to the intercepting vehicle, and 2) the thrust required to divert the intercepting vehicle in the desired direction to intercept the target. For example, when the estimated line of-sight (LOS) from intercepting vehicle 200 to the target is 100 km and the uncertainty in the location of the target orthogonal to the LOS is plus or minus 20 km, the FOV half-angle should be approximately 11.5 degrees for the target to be within the FOV. On the other hand, when divert thrust orthogonal to the LOS is approximately 25% of the rocket motor thrust, the FOV half-angle is approximately 14.5 degrees to keep the target within the FOV. It should be appreciated that in this example, the size of the FOV is dictated by the maneuver requirement.

Electronics unit 210 may include, but is not limited to, a computing system having at least one processor and memory, analog-to-digital converters, digital-to-analog converters, controllers (e.g., drivers), and a communication unit configured to receive electro-optical or electro-magnetic signals. In some embodiments, the communication unit may also transmit signals. See, for example, FIG. 7 for a more detailed discussion of an embodiment of a computing system. The communication unit may communicate with a ground station, airborne platform, ballistic platform, space system, etc. For example, the communication unit may receive target tracking updates and intercepting vehicle tracking updates from a ground tracking station or an airborne tracking platform.

In this embodiment, rocket motor 220 is an axial solid-fueled rocket motor. Depending on the configuration of intercepting vehicle 200, single axial rocket motor 220 may be a solid-fueled rocket motor, a liquid-fueled rocket motor, a hybrid rocket motor, an electric rocket motor, a gas rocket motor, a combination of these rocket motors, or any other type of rocket motor that would be appreciated by a person of ordinary skill in the art. Single axial rocket motor 220 provides intercepting vehicle 200 with thrust, which can be directed in the desired direction by the ACS. In this embodiment, TVC system 230 is an actuator of the ACS. Conduit (e.g., hollow tubes) 225 contains wires configured to power and control TVC system 230.

In certain embodiments, TVC system 230 directs the thrust of single axial rocket motor 220 along a line-of-action that misses the center-of-mass of intercepting vehicle 200, providing the main body of intercepting vehicle 200 with an appropriate torque. The torque produces angular accelerations of the main body of intercepting vehicle 200. This enables the IMU (or its rate gyros) 215, the computing system, and the TVC system 230 to provide intercepting vehicle 200 with closed-loop attitude control, to achieve a desired orientation of intercepting vehicle 200.

In some embodiments, TVC system 230 may include single axial rocket motor 220, a movable nozzle (not shown), and at least two linear actuators (not shown) for bending or pointing the nozzle with respect to single axial rocket motor 220. The nozzle may include a flexible part, and the linear actuators may steer the nozzle there between, providing the thrust in a desired direction relative to the main body of intercepting vehicle 200.

In some embodiments, TVC system 230 may include single axial rocket motor 220, a fixed nozzle (not shown), and jet vanes (not shown) to deflect the rocket exhaust flow, providing the thrust in a desired direction relative to the main body of intercepting vehicle 200.

In certain embodiments, rocket motor 220 and TVC system 230 may include single axial rocket motor 220, a fixed nozzle (not shown), and an injector (not shown) to inject fluid into the rocket exhaust flow to deflect the exhaust flow, providing the thrust in a desired direction relative to the main body of intercepting vehicle 200.

In certain embodiments, TVC system 230 may include single axial rocket motor 220, at least two fixed nozzles (not shown), and a modulator (not shown) to direct and modulate the exhaust flow from single axial rocket motor 220 to the nozzles. An asymmetric thrust distribution can be created about the center-of-mass of the intercepting vehicle, providing the thrust in a desired direction relative to the main body of intercepting vehicle 200.

In some embodiments, TVC system 230 may include single axial rocket motor 220, a fixed nozzle (not shown), and jet paddles (not shown) aft of the nozzle to obtain a force orthogonal to the rocket exhaust flow, providing the thrust in a desired direction relative to the main body of intercepting vehicle 200. In some embodiments, the fixed nozzle and jet paddles may be replaced with a variable geometry nozzle (not shown), to provide the same effect.

In some embodiments, TVC system 230 may include single axial rocket motor 220 mounted in a controllable gimbal system (not shown) attached to the main body of intercepting vehicle 200. By pointing the rocket motor in a desired direction relative to the main body, the thrust is provided in a desired direction relative to the main body of intercepting vehicle 200.

In some embodiments, TVC system 230 may include single axial rocket motor 220, a fixed nozzle (not shown), and movable mass (not shown), which constitute a portion of intercepting vehicle mass for moving the center-of-mass of intercepting vehicle 200 off the line-of-action of the thrust of the rocket motor. This allows the attitude of intercepting vehicle 200 to be controlled and to thrust in a desired direction.

It should be appreciated that TVC system 230 may include other approaches not described above and also combinations of the above TVC systems and other approaches.

Intercepting vehicle 200 may also include a non-TVC ACS (not shown), or an additional independent ACS (also not shown). Non-TVC ACS's for high-endo- and exo-atmospheric intercepting vehicles may use the following torque actuators: cold gas thrusters, warm/hot-gas thrusters, angular momentum storage devices such as reaction wheels, control moment gyros, magnetic torque coils, etc. Non-TVC ACS's for endo-atmospheric intercepting vehicles may use flaps, cold gas thrusters, warm/hot gas thrusters, etc. Any conceivable combination of the TVC and non-TVC ACS's described above, plus a rocket motor, may provide intercepting vehicle 200 with the ability to thrust in a desired direction.

Figure 3:
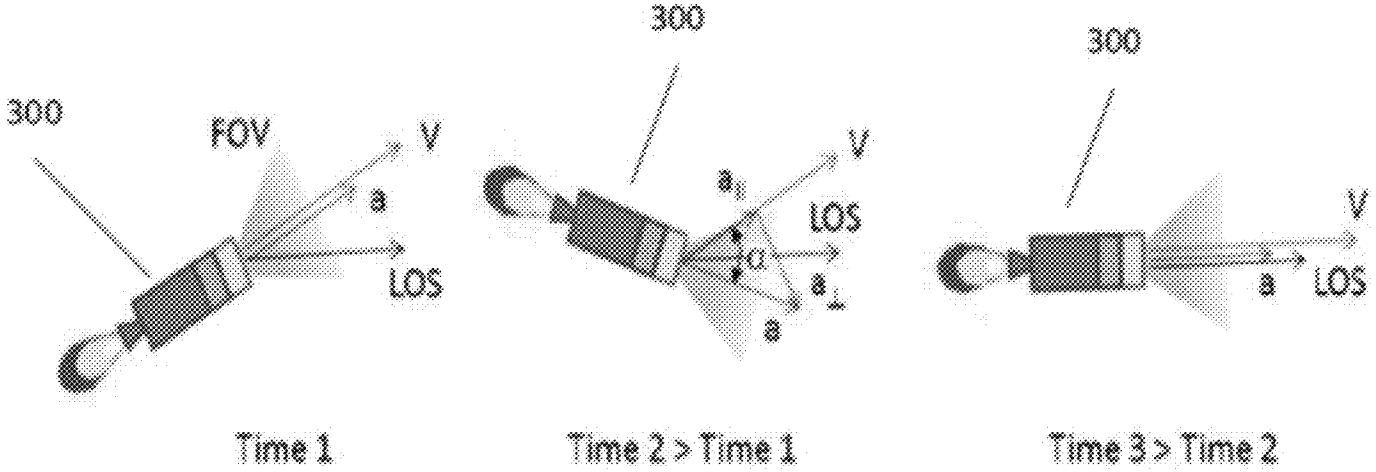
FIG. 3 illustrates steering of an intercepting vehicle to a ballistic (non-thrusting) target, according to an embodiment of the present invention.

FIG. 3 illustrates steering of an intercepting vehicle 300 to a ballistic (non-thrusting) target, according to an embodiment of the present invention. It should be appreciated that acceleration due to gravity may be neglected to simplify the illustration. Generally, there are two guidance phases—a command guidance phase and a homing guidance phase. For purposes of the embodiments described herein, FIG. 3 illustrates the homing guidance phase for intercepting vehicle 300. As discussed above, intercepting vehicle 300 includes a sensor unit (e.g., body-fixed sensor unit), an IMU, and a computing system, as well as a star tracker unit that is part of, or separate from, the sensor unit.

During the homing guidance phase, the body-fixed sensor unit is configured to point to the target such that it is within the FOV of the sensor unit, to detect and track the target. The IMU is configured to measure the attitude and the attitude rate of intercepting vehicle 300. Upon detection of the target by the sensor unit, the sensor unit is configured to measure the angular velocity of the LOS vector between the target and intercepting vehicle 300. This is shown at Time 1 in FIG. 3. The LOS vector for purposes of this embodiment refers to the unit position vector from intercepting vehicle 300 to the location of the target.

In this embodiment, intercepting vehicle 300 is not traveling in the correct direction to hit the ballistic target at Time 1 because relative acceleration vector a (equivalent to the inertial acceleration vector of intercepting vehicle 300 since the target is not thrusting) and relative velocity vector V (relative to the target) of intercepting vehicle 300 are not in line with the LOS vector. For purposes of this embodiment, in order to hit the target, the relative velocity vector V and relative acceleration vector a should be rotated to bring relative acceleration vector a and relative velocity vector V into alignment with the LOS vector. The relative velocity vector V may be rotated by directing the thrust of intercepting vehicle 300 so that a portion of the thrust, and therefore, the relative acceleration vector a, is orthogonal to relative velocity vector V and in the direction of the desired rotation for relative velocity vector V.

Furthermore, it should be appreciated that directing the thrust in this desired direction may require rotating intercepting vehicle 300. Because intercepting vehicle 300 has a body-fixed sensor unit having a wide FOV, intercepting vehicle 300 is able to make attitude adjustments without losing the LOS vector to the target. It should be appreciated that if the target is outside of the wide FOV due to the attitude change of intercepting vehicle 300, the target may be reacquired within the FOV of the sensor unit by readjusting the attitude of intercepting vehicle 300.

When relative velocity vector V and the LOS vector are not parallel, the LOS vector rotates. If relative velocity vector V and the LOS vector have their tails at intercepting vehicle 300, as shown in FIG. 3, then relative velocity vector V may be rotated in the direction of the rotation of the LOS vector to bring relative velocity vector V and the LOS vector into alignment. The rotation rate of the LOS vector is found by measuring the rotation of the LOS vector (or movement of the target) as observed by the body-fixed sensor unit, and then adding this rotation rate to that of intercepting vehicle 300, as measured by the IMU (or its rate gyros). The acceleration direction required to bring relative velocity vector V parallel with the LOS vector is in the sense of the rotation of the LOS vector. This acceleration direction is labeled $a_{\perp}$ in FIG. 3 at Time 2.

It should be appreciated that maneuver $a_{\perp}$ may be constrained by the FOV of the body-fixed sensor unit. The value of maneuver $a_{\perp}$ may also depend on the distance between intercepting vehicle 300 and the target. This distance may be derived from the IMU and the target trajectory (and if desired the trajectory of intercepting vehicle 300) transmitted to intercepting vehicle 300 by an external tracking system. The distance to the target may also be derived by measuring the change in the angular velocity of the LOS vector induced by the maneuvering of intercepting vehicle 300. For some embodiments, the distance to the target may be measured directly by the sensor unit, e.g., a radar or ladar. The maneuver $a_{\perp}$ in FIG. 3 rotates the relative velocity V of intercepting vehicle 300 in the direction of the LOS vector. When relative acceleration a, relative velocity V, and the LOS vector are parallel, as shown at Time 3 in FIG. 3, intercepting vehicle 300 is on a collision course with the target.

Figure 4:
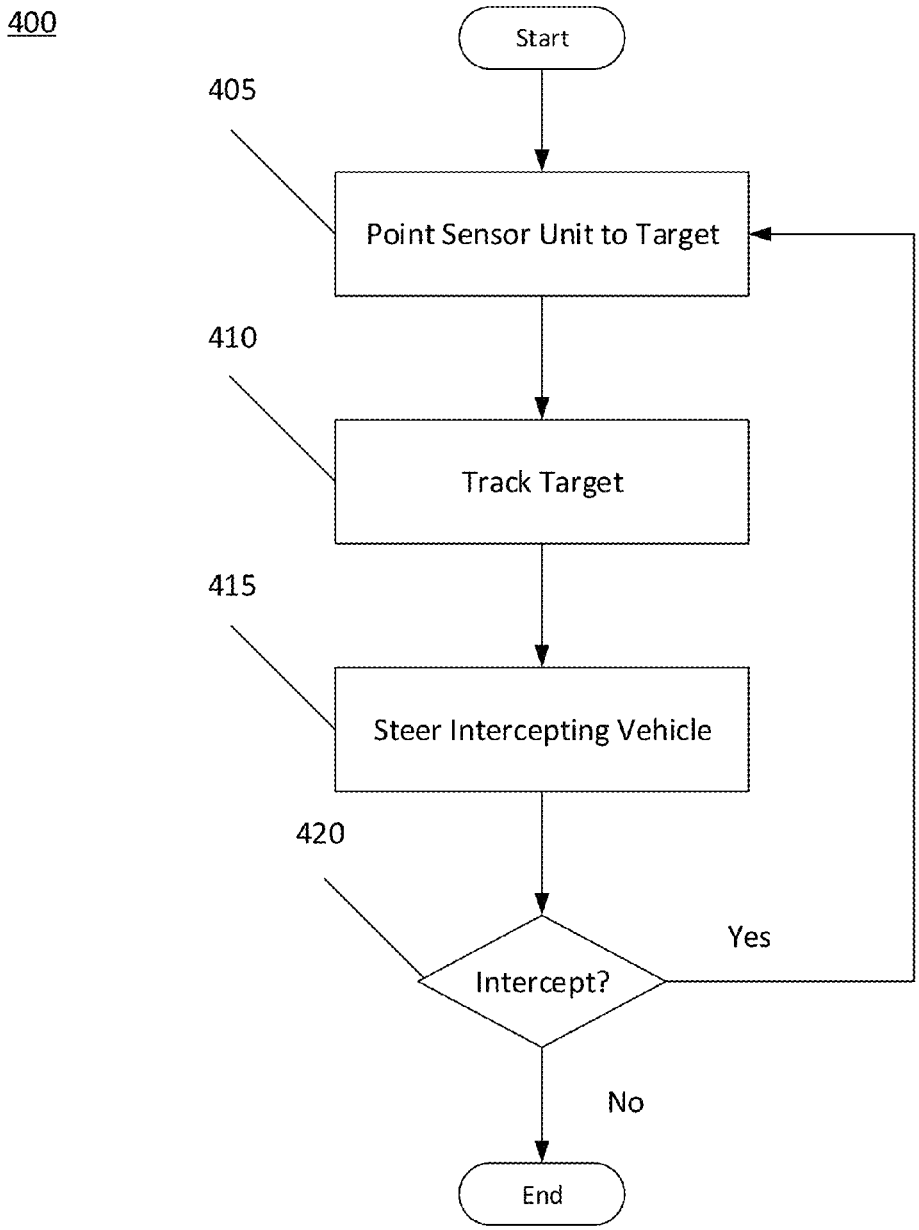
FIG. 4 is a flow diagram illustrating a process for operating an intercepting vehicle, according to an embodiment of the present invention.

FIG. 4 is a flow diagram 400 illustrating a process for operating an intercepting vehicle in, for example, a homing guidance phase, according to an embodiment of the present invention. The process of FIG. 4 may be executed by, for example, computing system 700 shown in FIG. 7. In this embodiment, the process begins at 405 with the computing system pointing the sensor unit, which may be a body-fixed sensor unit, to the target such that the target is within the FOV of the sensor unit. This is done using various components onboard the intercepting vehicle. These components may include, for example, the ACS, the TVC system, etc. At 410, the computing system is configured to track the target. At 415, the computing system is configured to cause the ACS, which in some embodiments may include the TVC system as its actuator, to steer the intercepting vehicle by rotating the intercepting vehicle such that the thrust from the single axial rocket motor is applied in the desired direction.

At 420, if it is determined that the target has not been intercepted, then the computing system returns to step 405 and repeats the process (e.g., steps 405-415). If the target has been intercepted, then the process ends, as the intercepting vehicle has intercepted the target. It should be appreciated that the steps shown above may be performed synchronously or sequentially depending on the configuration of the computing system.

Figure 5:
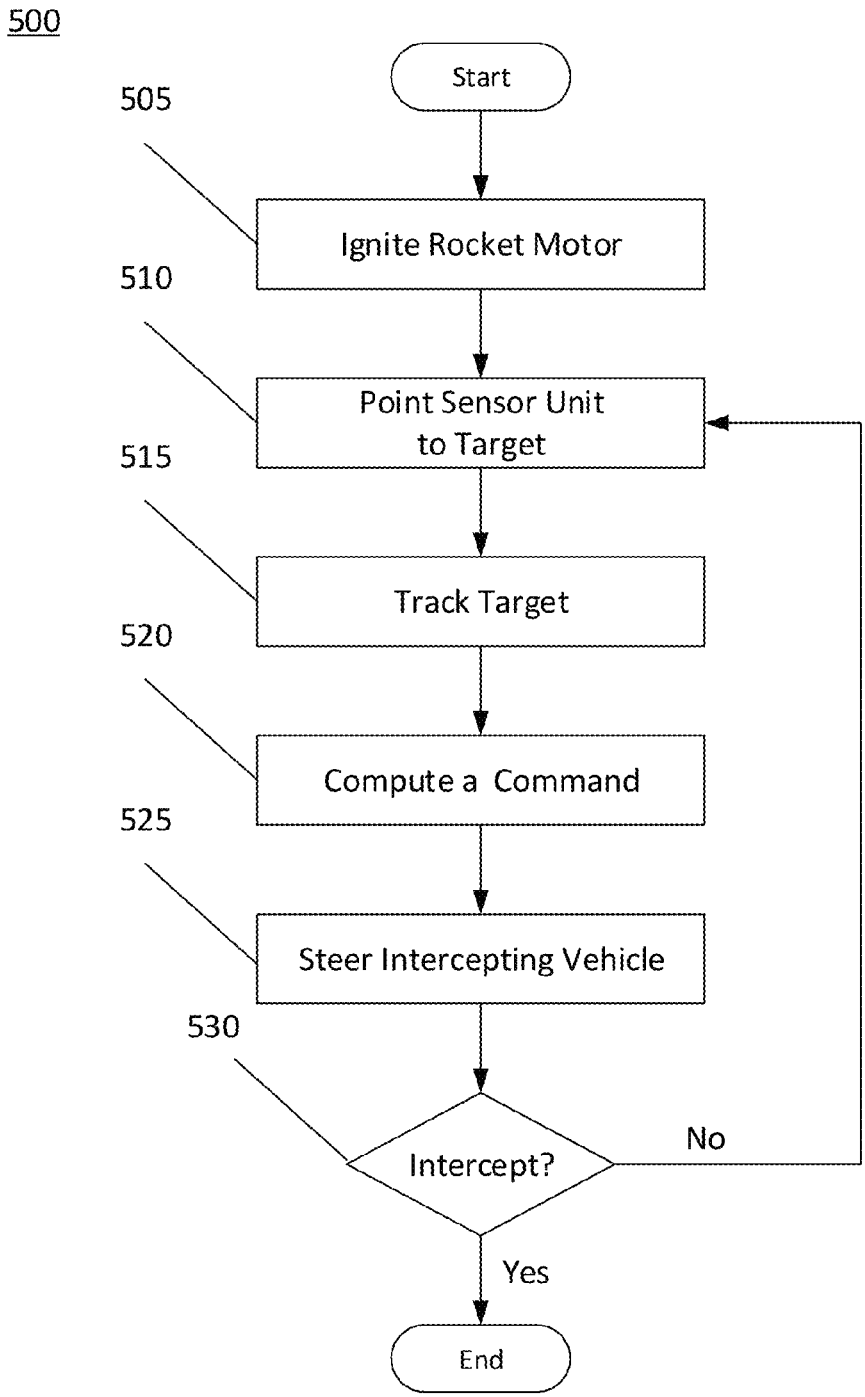
FIG. 5 is a flow diagram illustrating a process for operating an intercepting vehicle, according to an embodiment of the present invention.

FIG. 5 is a flow diagram 500 illustrating a process for operating an intercepting vehicle in, for example, a homing guidance phase, according to an embodiment of the present invention. The process of FIG. 5 may be executed, for example, by computing system 700 shown in FIG. 7.

In this embodiment, the process begins at 505 with the computing system igniting the single axial rocket motor. At 510, the computing system is configured to point the sensor unit, which may be a body-fixed sensor unit, to the target, such that the target is within the FOV of the sensor unit. At 515, the computing system is configured to track the target using the data received from the sensor unit, and compute a homing guidance command at 520. At 525, the computing system is configured to execute the command and steer the intercepting vehicle to the target.

At 530, if the target has not been intercepted, then the computing system returns to step 510. If the target has been intercepted, then the process ends, as the intercepting vehicle has intercepted the target. It should be appreciated that the steps shown above (e.g., steps 510-525) may be performed synchronously or sequentially depending on the configuration of the computing system.

Figure 6:
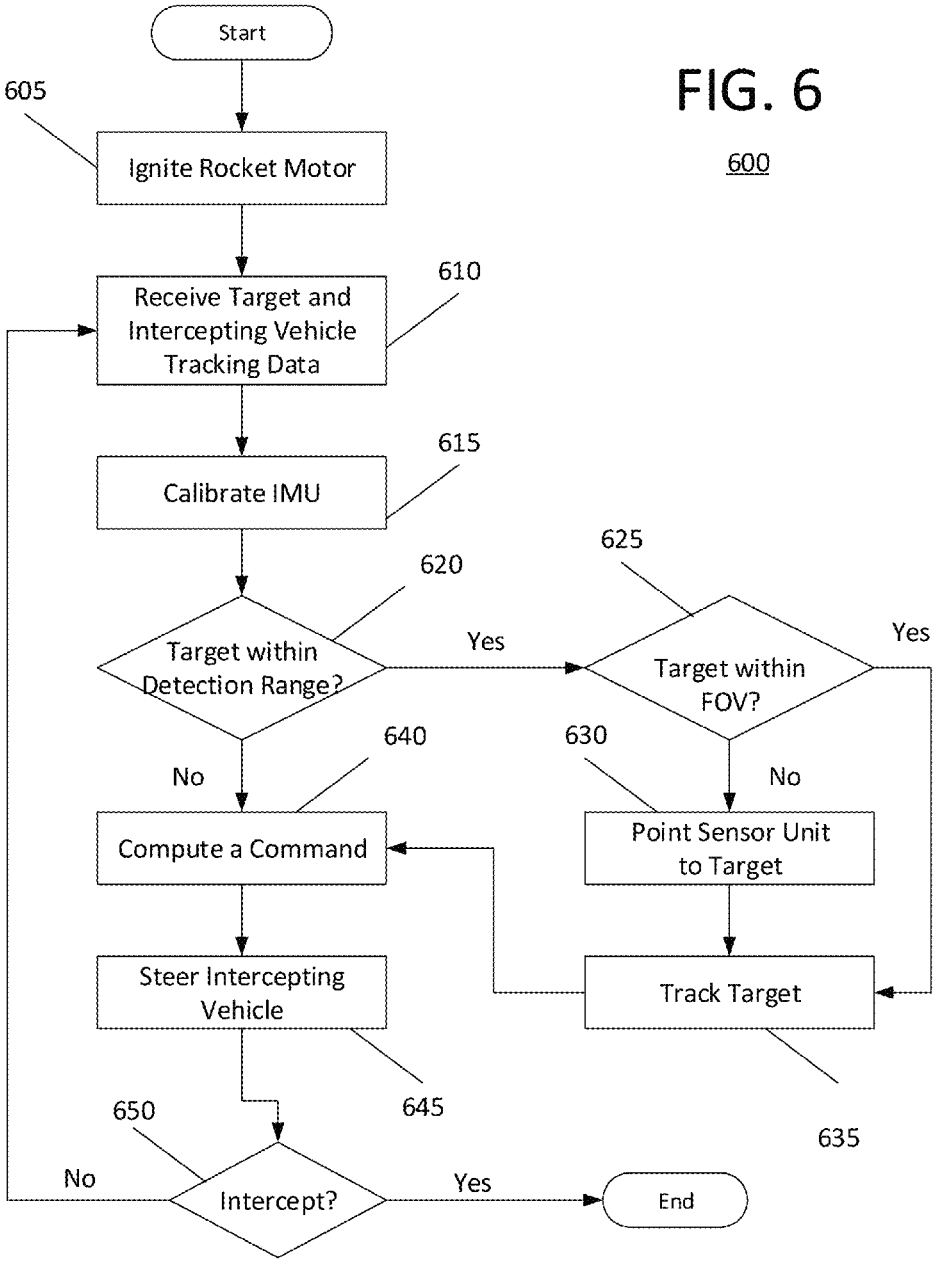
FIG. 6 is a flow diagram illustrating a process for operating an intercepting vehicle, according to an embodiment of the present invention.

FIG. 6 is a flow diagram 600 illustrating a process for operating an intercepting vehicle, according to an embodiment of the present invention. The process of FIG. 6 may be executed, for example, by computing system 700 shown in FIG. 7. This process may be used for a command guidance phase, homing guidance phase, or both. In this embodiment, the process begins at 605 with the computing system igniting a single axial rocket motor, and receiving target and intercepting vehicle tracking data at 610.

Using the received target and intercepting vehicle tracking data, and onboard star tracker data if available, the computing system is configured to calibrate the IMU at 615. It should be appreciated that the computing system initially presumes that the LOS distance to the target, which is the magnitude of the LOS vector, is beyond the detection range of the sensor unit, and therefore implements a command guidance command, as discussed above. At 620, when the target is within the detection range, or the LOS distance falls below the detection range of the sensor unit, which may be a body-fixed sensor unit, the computing system checks whether the target is within the FOV of the sensor unit at 625. At 630, if the target is not within the FOV, the computing system may rotate the intercepting vehicle using the ACS such that the sensor unit points toward the target and brings the target into the FOV. If, however, the target is within the FOV, the sensor unit detects the target and begins tracking the target at 635. The process then proceeds to step 640 where the computing system computes a homing guidance command in this case. If, however, the target is not within detection range at 620, the computing system at 640 continues to implement command guidance and computes a command guidance command.

It should be appreciated that any orientation of the intercepting vehicle is constrained such that the direction of the LOS vector is within the FOV of the sensor unit while the single axial rocket motor thrust is directed in the direction that ensures the required acceleration. At 645, the computing system is configured to cause the ACS to steer the intercepting vehicle by rotating the intercepting vehicle such that the thrust from the single axial rocket motor is applied in the desired direction. At 650, if the target has not been intercepted, the process returns to step 610, and the computing system executes the process until the target has been intercepted. It should also be appreciated that the process of FIG. 6 may be executed sequentially or simultaneously depending on the configuration of the computing system on board the intercepting vehicle.

Figure 7:
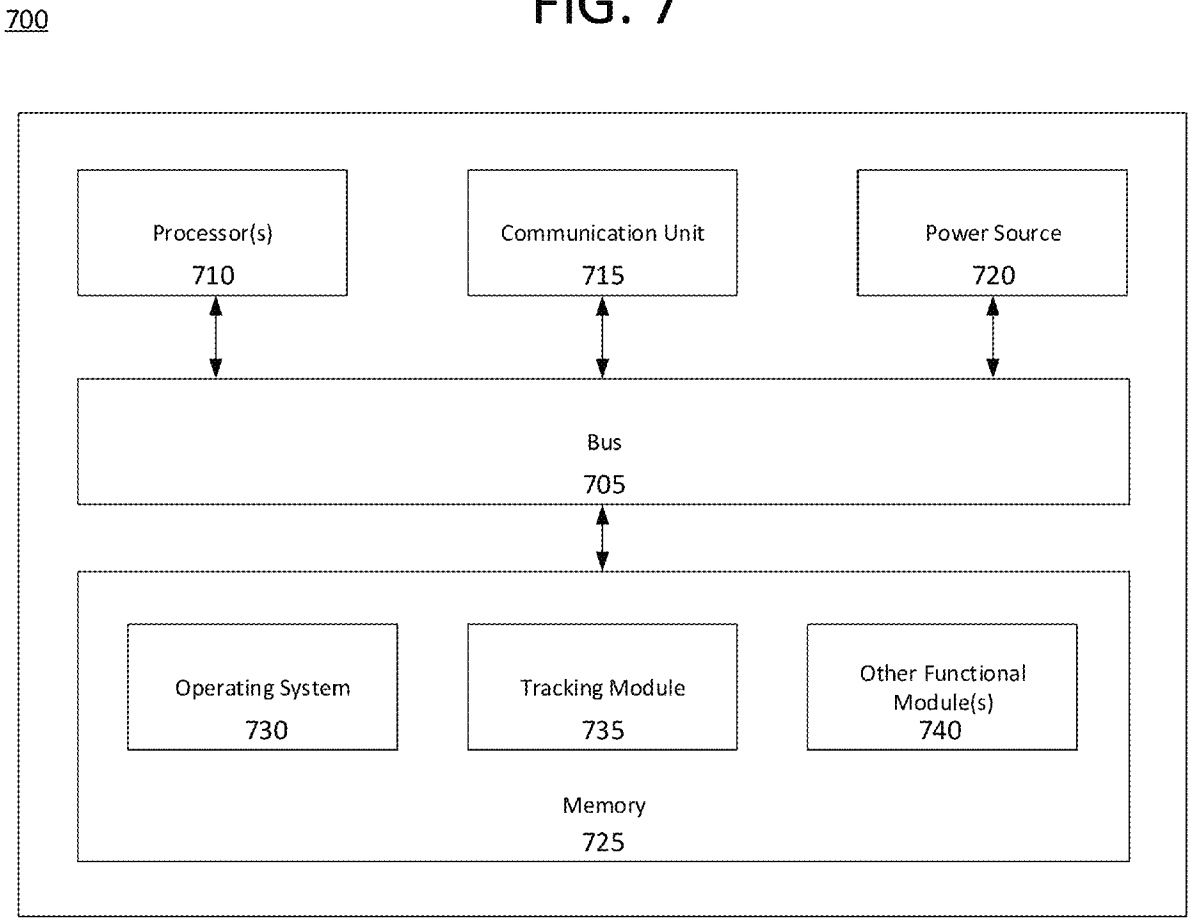
FIG. 7 illustrates a block diagram of a computing system for controlling an intercepting vehicle, according to one embodiment of the present invention.

FIG. 7 is a block diagram 700 illustrating a computing system for controlling an intercepting vehicle, according to an embodiment of the present invention. Computing system 700 includes a bus 705 or other communication mechanism configured to communicate information, and at least one processor 710, coupled to bus 705, configured to process information. At least one processor 710 can be any type of general or specific purpose processor. Computing system 700 also includes memory 725 configured to store information and instructions to be executed by at least one processor 710. Memory 725 can be comprised of any combination of random access memory ("RAM"), read only memory ("ROM"), static storage such as a magnetic or optical disk, or any other type of computer readable medium. Computing system 700 also includes a communication device 715, such as a network interface card, configured to provide access to a network. Computing system 700 also includes power source 720 to power computing system 700, and possibly, the intercepting vehicle.

The computer readable medium may be any available media that can be accessed by at least one processor 710. The computer readable medium may include both volatile and nonvolatile media, removable and non-removable media, and communication media. The communication media may include computer readable instructions, data structures, program modules, or other data and may include any information delivery media.

According to one embodiment, memory 725 may store software modules that may provide functionality when executed by at least one processor 710. The modules can include an operating system 730 and a tracking module 735, as well as other functional modules (or drivers) 740. Operating system 730 may provide operating system functionality for computing system 700. Because computing system 700 may be part of a larger system, computing system 700 may include one or more additional functional modules 740 to include the additional functionality. For example, functional modules 740 may include, but are not limited to, a TVC module, an ACS module, a sensor module, etc.

One skilled in the art will appreciate that a "system" could be embodied as a personal computer, a server, a console, a personal digital assistant (PDA), a cell phone, a tablet computing device, an embedded control system, or any other suitable computing device, or combination of devices on the ground or an embedded computing system on the vehicle. Presenting the above-described functions as being performed by a "system" is not intended to limit the scope of the present invention in any way, but is intended to provide one example of many embodiments of the present invention. Indeed, methods, systems and apparatuses disclosed herein may be implemented in localized and distributed forms consistent with computing technology.

It should be noted that some of the system features described in this specification have been presented as modules, in order to more particularly emphasize their implementation independence. For example, a module may be implemented as a hardware circuit comprising custom very large scale integration (VLSI) circuits or gate arrays, off-the-shelf semiconductors such as logic chips, transistors, or other discrete components. A module may also be implemented in programmable hardware devices such as field programmable gate arrays, programmable array logic, programmable logic devices, graphics processing units, or the like.

A module may also be at least partially implemented in software for execution by various types of processors. An identified unit of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. Further, modules may be stored on a computer-readable medium, which may be, for instance, a hard disk drive, flash device, random access memory (RAM), tape, or any other such medium used to store data.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The processes shown in FIGS. 4-6 may be performed, in part, by a computer program, encoding instructions for a nonlinear adaptive processor to cause at least the processes described in FIGS. 4-6 to be performed by the apparatuses discussed herein. The computer program may be embodied on a non-transitory computer readable medium. The computer readable medium may be, but is not limited to, a hard disk drive, a flash device, a random access memory, a tape, or any other such medium used to store data. The computer program may include encoded instructions for controlling the nonlinear adaptive processor to implement the processes described in FIGS. 4-6, which may also be stored on the computer readable medium.

The computer program can be implemented in hardware, software, or a hybrid implementation. The computer program can be composed of modules that are in operative communication with one another, and which are designed to pass information or instructions to display. The computer program can be configured to operate on a general purpose computer, or an application specific integrated circuit ("ASIC").

Embodiments of the present invention pertain to an intercepting vehicle containing a wide FOV body-fixed sensor unit and axial motor, where the thrust and FOV are sized to allow the intercepting vehicle to hit the target.

One having ordinary skill in the art will readily understand that the invention as discussed above may be practiced with steps in a different order, and/or with hardware elements in configurations that are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a computing system configured to sequentially or synchronously operate at least one body-fixed sensor unit, an inertial measurement unit, an attitude control system, and at least one axial rocket motor, such that thrust from the at least one axial rocket motor is applied in a direction that allows the apparatus to intercept a target or applied in a direction of an estimated intercept point, wherein the at least one body-fixed sensor unit comprising a wide field of view to detect the target.

2. The apparatus of claim 1, wherein the at least one body-fixed sensor unit is configured to point to the target by adjusting an attitude of the apparatus such that the target is periodically within the field of view prior to reaching the estimated intercept point.

3. The apparatus of claim 1, further comprising:

a communication unit configured to receive data from an external system, wherein the data comprises information to estimate a location, a location and velocity, or a location, velocity and acceleration, of the target and the apparatus in a same inertial reference frame.

4. The apparatus of claim 1, wherein the inertial measurement unit is configured to measure an attitude rate or an attitude and the attitude rate of the apparatus.

5. The apparatus of claim 4, wherein the inertial measurement unit is further configured to measure an acceleration, a velocity and acceleration, or a location, velocity, and acceleration of the apparatus.

6. The apparatus of claim 1, further comprising:

a star tracker configured to measure an attitude, or the attitude and an attitude rate, of the apparatus.

7. The apparatus of claim 1, wherein the at least one body-fixed sensor unit comprises a star tracker configured to measure an attitude, or the attitude and an attitude rate, of the apparatus.

8. The apparatus of claim 1, wherein the at least one body-fixed sensor unit is further configured to measure a direction vector, an angular velocity vector, or both, of a line of sight vector relative to the apparatus, the line of sight vector identifying a direction from the apparatus to a location of the target.

9. The apparatus of claim 1, wherein the computing system is further configured to determine an inertial angular velocity vector of a line of sight vector based on an angular velocity vector of a line of sight vector relative to the apparatus and on an inertial angular velocity vector of the apparatus.

10. The apparatus of claim 9, wherein the computing system is further configured to compute a guidance command, calculate an acceleration vector, and implement a maneuver that causes the apparatus to intercept the target subject to an attitude constraint applied to the apparatus.

11. The apparatus of claim 9, wherein the computing system is configured to compute a guidance command and implement a maneuver subject to a constraint that the target is periodically within the field of view of the at least one body-fixed sensor unit.

12. A method, comprising:

detecting a target by a body-fixed sensor unit onboard an intercepting vehicle;

rotating, by a computing system, at least one axial rocket motor of the intercepting vehicle such that the target periodically remains within a field of view of the body-fixed sensor unit; and simultaneously or synchronously operating, by the computing system, the body-fixed sensor unit, an inertial measurement unit, an attitude control system, and the at least one axial rocket motor such that thrust from the at least one axial rocket motor is applied in a direction that allows the intercepting vehicle to intercept the target.

13. The method of claim 12, wherein the rotating of the at least one axial rocket motor comprises:

rotating, by the attitude control system, the at least one axial rocket motor such that the intercepting vehicle accelerates in a direction to intercept the target while periodically maintaining the target within the field of view of the body-fixed sensor unit during rotation.

14. The method of claim 12, further comprising:

rotating the intercepting vehicle, by the attitude control system using a thrust vector control system or a non-thrust vector control system.

15. An intercepting vehicle, comprising:

a sensor unit comprising a wide field of view and configured to detect a target; and a computing system configured to simultaneously or synchronously operate the sensor unit, an inertial measurement unit, an attitude control system, and at least one axial rocket motor such that thrust from the at least one axial rocket motor is applied in a direction that allows the intercepting vehicle to intercept the target.

16. The intercepting vehicle of claim 15, wherein the sensor unit comprises a body-fixed sensor unit or a body-mounted sensor unit.

17. The intercepting vehicle of claim 15, wherein the at least one axial rocket motor comprises a solid-fueled rocket motor, a liquid-fueled rocket motor, a hybrid rocket motor, an electric rocket motor, or a gas rocket motor.

18. The intercepting vehicle of claim 15, further comprising:

at least one hollow tube attached to the at least one single rocket motor configured to pass wires from an electronics unit to a thrust vector control system to power and control the thrust vector control system.

19. The intercepting vehicle of claim 15, wherein the sensor unit is further configured to measure a direction vector, an angular velocity vector, or both, of a line of sight vector from the intercepting vehicle to the target.

20. The intercepting vehicle of claim 15, wherein the attitude control system is configured to perform attitude adjustment of the intercepting vehicle to intercept the target while constraining the target to periodically remain within the wide field of view of the sensor unit.

21. The intercepting vehicle of claim 20, wherein the attitude control system comprises a thrust vector control system for actuation.

22. The intercepting vehicle of claim 20, wherein the attitude control system comprises a non-thrust vector control system for actuation.

23. The intercepting vehicle of claim 20, wherein the attitude control system comprises a combination of a thrust vector control system and a non-thrust vector control system for actuation.

24. The intercepting vehicle of claim 20, wherein the attitude control system is configured to rotate the intercepting vehicle such that the intercepting vehicle accelerates in a direction to align a relative velocity vector with a line of sight vector.

25. The intercepting vehicle of claim 15, wherein the inertial measurement unit is configured to measure an attitude rate or an attitude and the attitude rate of the intercepting vehicle.

26. The intercepting vehicle of claim 15, wherein the inertial measurement unit is further configured to measure an acceleration, a velocity and acceleration, or a location, velocity, and acceleration of the intercepting vehicle.

* * * * *